US005337570A

United States Patent [19]

Prosser

[11] Patent Number: 5,337,570

[45] Date of Patent: Aug. 16, 1994

[54] CRYOGENIC RECTIFICATION SYSTEM FOR PRODUCING LOWER PURITY OXYGEN

[75] Inventor: Neil M. Prosser, East Amherst, N.Y.

[73] Assignee: Praxair Technology, Inc., Danbury, Conn.

[21] Appl. No.: 94,869

[22] Filed: Jul. 22, 1993

[51] Int. Cl.[5] ..... F25J 3/02

[52] U.S. Cl. ..... 62/25; 62/38; 62/41

[58] Field of Search ..... 62/25, 38, 41

[56] References Cited

U.S. PATENT DOCUMENTS

| | | | |
|---|---|---|---|
| 2,209,748 | 7/1940 | Schlitt | 62/175.5 |
| 3,210,951 | 10/1965 | Gaumer, Jr. | 62/29 |
| 3,277,655 | 10/1966 | Geist et al. | 62/29 |
| 3,327,489 | 6/1967 | Gaumer, Jr. | 62/29 |
| 3,754,406 | 8/1973 | Allam | 62/41 |
| 4,208,199 | 6/1980 | Nakazato et al. | 62/29 |
| 4,224,045 | 9/1980 | Olszewski et al. | 62/30 |
| 4,254,629 | 3/1981 | Olszewski | 62/13 |
| 4,410,343 | 10/1983 | Ziemer | 62/29 |
| 4,448,595 | 5/1984 | Cheung | 62/31 |
| 4,702,757 | 10/1987 | Kleinberg | 62/24 |
| 4,704,148 | 11/1987 | Kleinberg | 62/24 |
| 4,936,099 | 6/1990 | Woodward et al. | 62/24 |
| 5,114,449 | 5/1992 | Agrawal et al. | 62/24 |
| 5,123,249 | 6/1992 | Buttle | 62/38 |
| 5,144,808 | 9/1992 | Ha | 62/24 |
| 5,157,926 | 10/1992 | Guilleminot | 62/24 |

*Primary Examiner*—Ronald C. Capossela
*Attorney, Agent, or Firm*—Stanley Ktorides

[57] ABSTRACT

A cryogenic rectification system for producing lower purity oxygen wherein a higher pressure feed air stream is used to reboil the bottoms of a lower pressure column and a lower pressure feed air stream is fed directly into a higher pressure column.

10 Claims, 4 Drawing Sheets

CRYOGENIC RECTIFICATION SYSTEM FOR PRODUCING LOWER PURITY OXYGEN

TECHNICAL FIELD

This invention relates generally to cryogenic rectification and more particularly to the production of lower purity oxygen.

BACKGROUND ART

The cryogenic rectification of air to produce oxygen and nitrogen is a well established industrial process. Typically the feed air is separated in a double column system wherein nitrogen shelf or top vapor from a higher pressure column is used to reboil oxygen bottom liquid in a lower pressure column.

The demand for lower purity oxygen is increasing in applications such as glassmaking, steelmaking and energy production. Less vapor boilup in the stripping sections of the lower pressure column, and less liquid reflux in the enriching sections of the lower pressure column are necessary for the production of lower purity oxygen which has an oxygen purity of less than 98.5 mole percent, than are typically generated by the operation of a double column.

Accordingly, lower purity oxygen is generally produced in large quantities by a cryogenic rectification system wherein feed air at the pressure of the higher pressure column is used to reboil the liquid bottoms of the lower pressure column and is then passed into the higher pressure column. The use of air instead of nitrogen to vaporize the lower pressure column bottoms reduces the air feed pressure requirements, and enables the generation of only the necessary boil-up in the stripping sections of the lower pressure column either by feeding the appropriate portion of the air to the lower pressure column reboiler or by partially condensing a larger portion of the total feed air.

While the conventional air boiling cryogenic rectification system has been used effectively for the production of lower purity oxygen, its ability to generate liquid nitrogen reflux for supply to the top of the lower pressure column is limited. This results from the lower component relative volatilities at the operating pressure of the higher pressure column which is similar to that of the main air feed. More power is consumed because oxygen recovery is reduced as a result of the reduced capability to generate liquid nitrogen reflux.

Accordingly, it is an object of this invention to provide a cryogenic rectification system for producing lower purity oxygen wherein the liquid bottoms of a lower pressure column are reboiled by indirect heat exchange with feed air and which operates with reduced power requirements over that of conventional air boiling systems.

SUMMARY OF THE INVENTION

The above and other objects which will become apparent to one skilled in the art upon a reading of the disclosure are attained by the present invention one aspect of which is:

A cryogenic rectification method for producing lower purity oxygen comprising:

(A) providing a cryogenic rectification plant comprising a first column with a top condenser and a second column with a bottom reboiler, said first column operating at a pressure which exceeds that of the second column;

(B) providing a first feed air stream at a pressure within the range of from 39 to 100 psia and passing said feed air stream through said bottom reboiler;

(C) passing feed air from the bottom reboiler into at least one of said first and second columns;

(D) providing a second feed air stream at a pressure less than that of the first feed air stream and passing said second feed air stream into the first column;

(E) withdrawing lower purity oxygen from the second column and warming said withdrawn lower purity oxygen by indirect heat exchange with said first feed air stream and with said second feed air stream; and (F) recovering resulting warmed lower purity oxygen as product.

Another aspect of the invention is

A cryogenic rectification apparatus for producing lower purity oxygen comprising:

(A) a first column with a top condenser and a second column with a bottom reboiler;

(B) a main heat exchanger, and means for passing a first feed stream to the main heat exchanger and from the main heat exchanger to the bottom reboiler;

(C) means for passing fluid from the bottom reboiler into at least one of said first and second columns;

(D) means for passing a second feed stream, at a pressure less than that of the first feed stream, to the main heat exchanger and from the main heat exchanger into the first column;

(E) means for passing product fluid from the second column to the main heat exchanger; and (F) means for recovering product fluid from the main heat exchanger.

As used herein the term "lower purity oxygen" means a fluid having an oxygen concentration of 98.5 mole percent or less.

As used herein, the term "feed air" means a mixture comprising primarily nitrogen and oxygen, such as air.

As used herein, the terms "turboexpansion" and "turboexpander" mean respectively method and apparatus for the flow of high pressure gas through a turbine to reduce the pressure and the temperature of the gas thereby generating refrigeration.

As used herein, the term "column" means a distillation of fractionation column or zone, i.e., a contacting column or zone wherein liquid and vapor phases are countercurrently contacted to effect separation of a fluid mixture, as for example, by contacting or the vapor and liquid phases on a series of vertically spaced trays or plates mounted within the column and/or on packing elements which may be structured packing and/or random packing elements. For a further discussion of distillation columns, see the Chemical Engineer's Handbook fifth edition, edited by R. H. Perry and C. H. Chilton, McGraw-Hill Book Company, New York, Section 13, *The Continuous Distillation Process.*

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phase is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin.

As used herein, the term "indirect heat exchange" means the bringing of two fluid streams into heat exchange relation without any physical contact or intermixing of the fluids with each other.

As used herein, the term "top condenser" means a heat exchange device which generates column downflow liquid from column top vapor.

As used herein, the term "bottom reboiler" means a heat exchange device which generates column upflow vapor from column bottom liquid.

DETAILED DESCRIPTION

The invention is an improved cryogenic rectification system which enables the production of lower purity oxygen with lower feed compression requirements than conventional systems while still attaining high yield. The invention is particularly advantageous for the production of lower purity oxygen having an oxygen concentration within the range of from 70 to 98 mole percent but is also very useful for the production of lower purity oxygen having an oxygen concentration within the range of from 50 to 98.5 mole percent.

Figure 1:
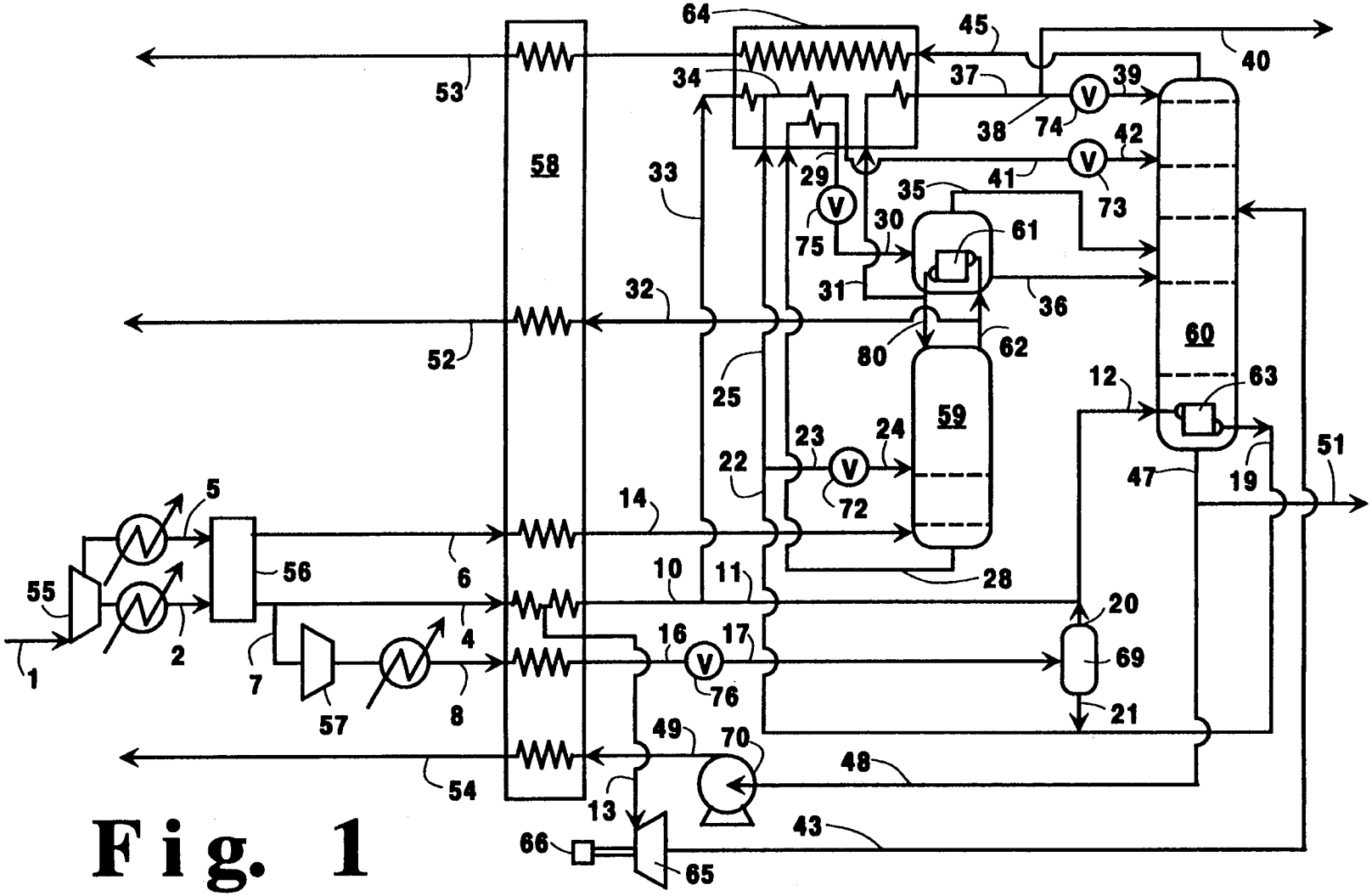
FIG. 1 is a schematic representation of one preferred embodiment of the invention wherein lower purity oxygen liquid is pumped to a higher pressure and vaporized in the main heat exchanger.

The invention will be described in detail with reference to the Drawings. Referring now to FIG. 1, feed air 1 is passed into compressor 55 for compression. A first feed air stream 2 is withdrawn from compressor 55 at a pressure within the range of from 39 to 100 pounds per square inch absolute (psia). A second feed air stream 5 is withdrawn from compressor 55 upstream of the final compressor stage such that stream 5 is at a pressure less than that of stream 2 and generally within the range of from 35 to 75 psia. Alternatively, the feed air could be compressed to two different pressure levels using two separate compressors. Both streams 2 and 5 are cooled to remove heat of compression and are passed through purifier 56 for removal of high boiling impurities such as water vapor, carbon dioxide and some hydrocarbons.

The first air stream is then passed through bottom reboiler 63 of second column 60. Generally the first feed air stream which is passed through the bottom reboiler comprises from 10 to 50 percent of the total feed air. In the embodiment illustrated in FIG. 1 a portion 7 of the first feed air stream 4, generally comprising from 20 to 36 percent of the total feed air, is further compressed through compressor 57, cooled to remove heat of compression and passed through main heat exchanger 58 wherein it is at least partially condensed by indirect heat exchange with return streams. Resulting stream 16 is reduced in pressure through valve 76 and passed as stream 17 into phase separator 69. Liquid 21 from phase separator 69 is passed into line 19 and vapor 20 from phase separator 69 is passed into line 11 as will be further described later.

First feed air stream 4 is passed through main heat exchanger 58 wherein it is cooled by indirect heat exchange with return streams. In the embodiment illustrated in FIG. 1, a portion 13 of first feed air stream 4, generally comprising from 5 to 30 percent of the total feed air, is withdrawn after only partial traverse of main heat exchanger 58 and turboexpanded through turboexpander 65 to generate refrigeration and to generate electric power by means of generator 66. Resulting stream 43 is then passed into second column 60 which is operating at a pressure within the range of from 15 to 26 psia. While it is generally preferable to withdraw a portion of first feed air stream 4 for turboexpansion, there are instances when it may be preferable to withdraw a portion of second feed air stream 6 or a portion of the further compressed stream 8 for turboexpansion.

The first feed air stream emerges from main heat exchanger 58 as stream 10. In the embodiment illustrated in FIG. 1 a portion 33, generally comprising from 1 to 5 percent of the total feed air, is passed through heat exchanger 64 wherein it is cooled by indirect heat exchange with return streams and then passed into second column 60. The use of this stream is optional.

Remaining first feed air stream 11 is combined with stream 20 and the resulting combined stream 12 is passed through bottom reboiler 63 of second column 60. Within the bottom reboiler at least some of the feed air passed into the bottom reboiler is condensed by indirect heat exchange with the liquid bottoms of the second column. Generally the feed air passed into the bottom reboiler is totally condensed by this indirect heat exchange.

Feed air is passed out of bottom reboiler 63 as stream 19 and combined with stream 21 to form combined stream 22. A portion 23 of the feed air from the bottom reboiler is passed through valve 72 and as stream 24 into first column 59 which is operarating at a pressure which exceeds that of second column 60 and generally is within the range of from 35 to 75 psia. Another portion 25 of the feed air from the bottom reboiler is combined with stream 33 in heat exchanger 64 to form combined stream 34 which is then passed out of heat exchanger 64 as stream 41, through valve 73 and a stream 42 into second column 60.

The second feed air stream comprises from 25 to 55 percent of the total feed air. The cleaned second feed air stream 6 is passed through main heat exchanger 58 wherein it is cooled by indirect heat exchange with return streams, and thereafter is passed as stream 14 into first column 59. In the illustrated embodiments the main heat exchanger is shown as a single unit. It is recognized that the main heat exchanger could also comprise a plurality of units.

Within first column 59, the feed air is separated by cryogenic rectification into nitrogen-enriched top vapor and oxygen-enriched bottom liquid. Nitrogen-enriched top vapor 62 is passed into top condenser 61 of first column 59 wherein it is condensed against first column bottoms as will be more fully described. If desired, a portion 32 of nitrogen-enriched top vapor 62 may be passed through main heat exchanger 58 and recovered as nitrogen product 52 having a nitrogen concentration generally within the range of from 95 to 99.999 mole percent. Condensed nitrogen-enriched fluid 80 is passed back into first column 59 as reflux. A portion 31 of the nitrogen-enriched fluid is passed partly through heat exchanger 64 and emerges as stream 37. If desired, a portion 40 of stream 37 may be recovered as product liquid nitrogen. Remaining stream 38 is passed through valve 74 and as stream 39 into second column 60 as reflux.

Oxygen-enriched bottom liquid is passed as stream 28 from first column 59 partly through heat exchanger 64 from which it emerges as stream 29. This stream is then passed through valve 75 and as stream 30 into top condenser 61 of first column 59. Within top condenser 61 the oxygen-enriched bottom liquid is partially vaporized by indirect heat exchange with the aforesaid condensing nitrogen-enriched vapor. The resulting oxygen-enriched vapor and remaining oxygen-enriched liquid are passed as streams 35 and 36 respectively from top condenser 61 into second column 60.

Within second column 60 the fluids fed into the column are separated by cryogenic rectification into nitrogen top vapor and lower purity oxygen. Nitrogen top vapor is withdrawn from the second column 60 as stream 45 passed through heat exchangers 64 and 58 and removed from the system and, if desired, recovered as stream 53 having a nitrogen concentration generally within the range of from 96 to 99.7 mole percent.

Lower purity oxygen is withdrawn from the second column warmed by indirect heat exchange with the first and second feed air streams, such as by passage through the main heat exchanger, and recovered as product lower purity oxygen. In the embodiment illustrated in FIG. 1, lower purity oxygen is withdrawn from second column 60 as liquid stream 47 and, if desired, a portion 51 may be recovered as liquid lower purity oxygen in stream 51. The remaining portion 48 is pumped to a higher pressure by passage through liquid pump 70 and the resulting pressurized liquid stream 49 is vaporized by passage through main heat exchanger 58 by indirect heat exchange with the aforesaid feed air streams. Portion 48 may be increased in pressure by any other suitable means such as by gravity head, thus eliminating the need for liquid pump 70. Resulting vapor stream 54 is recovered as lower purity oxygen product.

Figure 2:
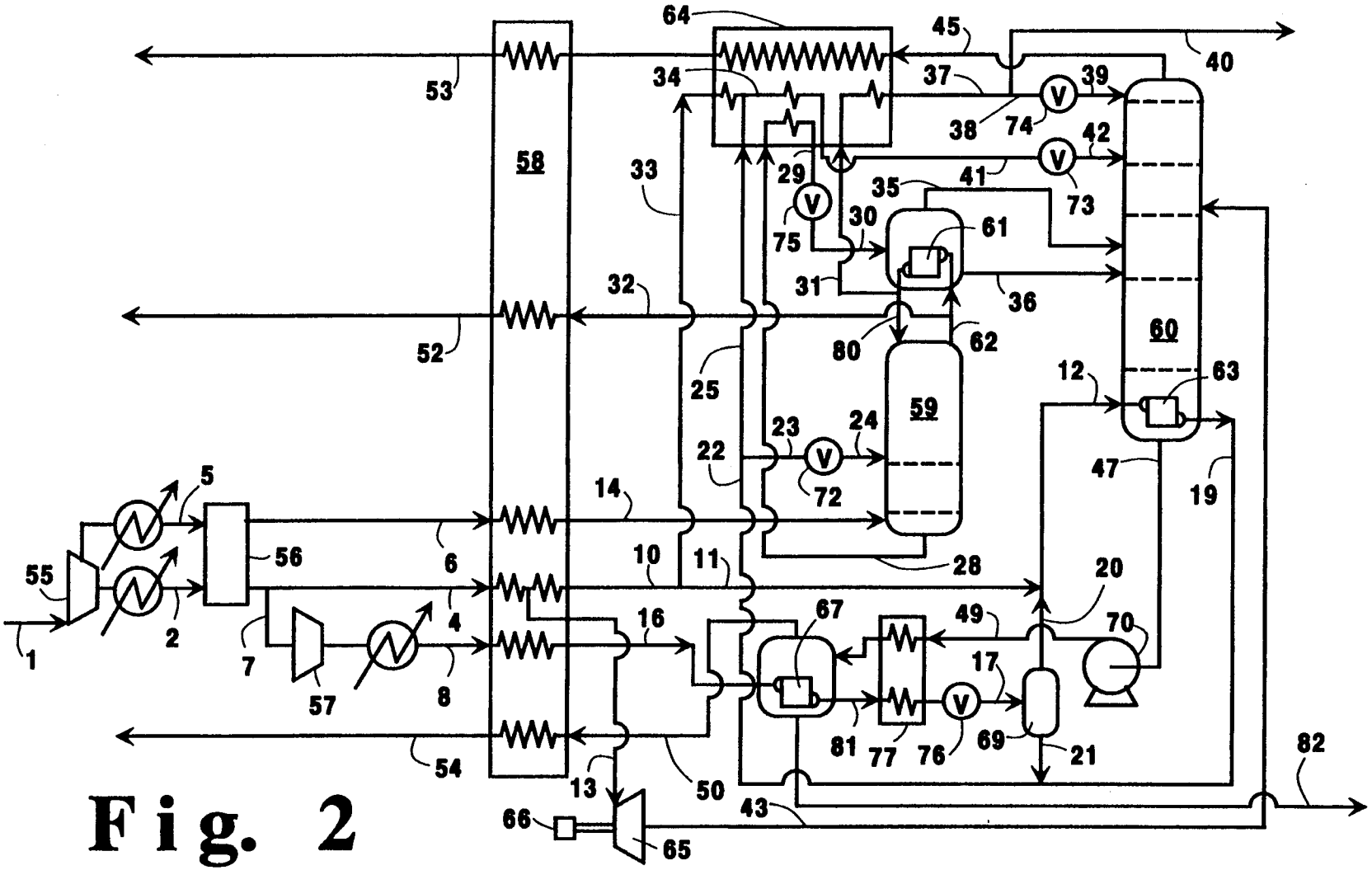
FIG. 2 is a schematic representation of another preferred embodiment of the invention wherein lower purity oxygen liquid is pumped to a higher pressure and vaporized in a product boiler.
Figure 3:
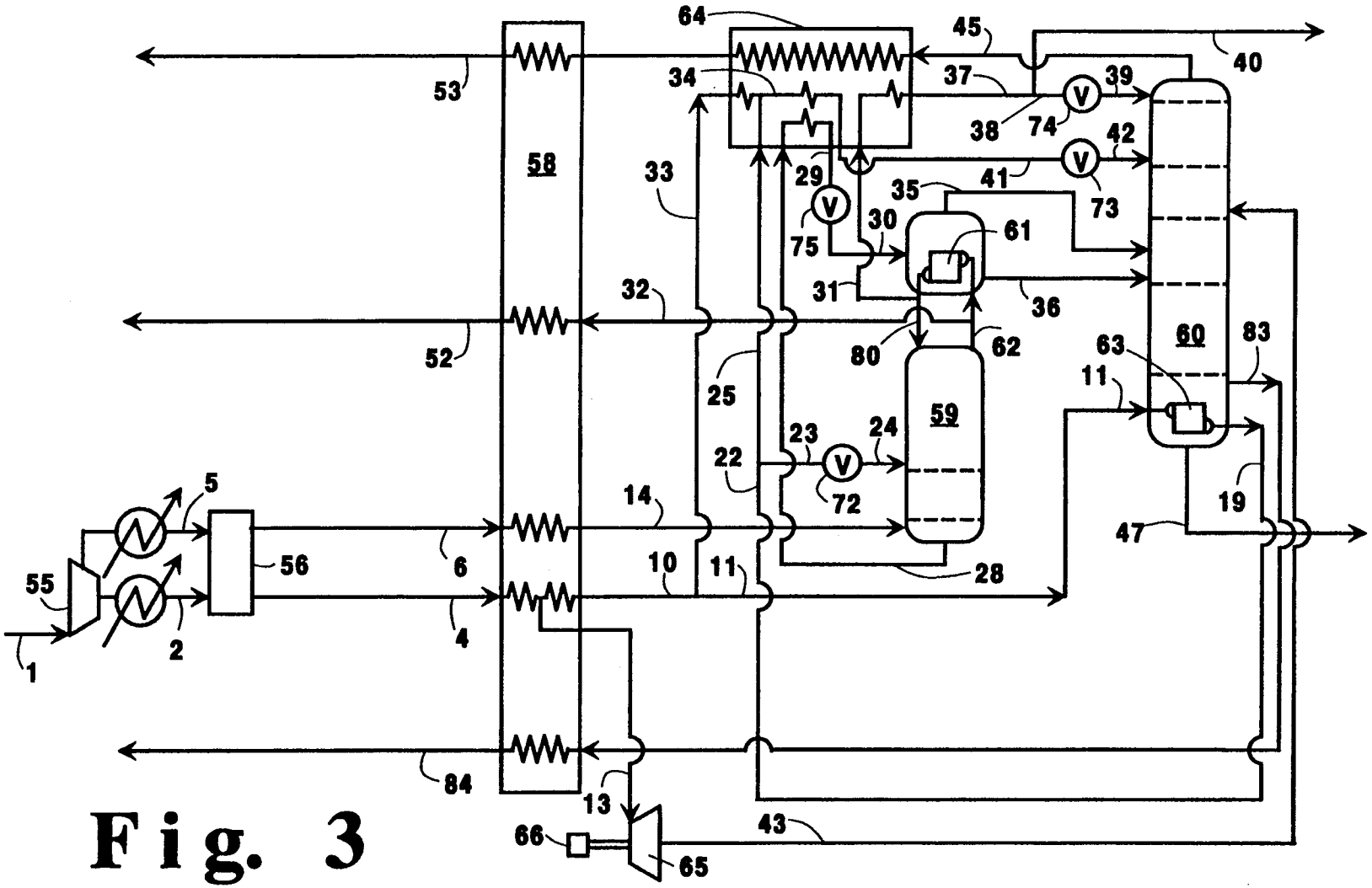
FIG. 3 is a schematic representation of another preferred embodiment of the invention wherein lower purity oxygen vapor is withdrawn from the lower pressure column and recovered.
Figure 4:
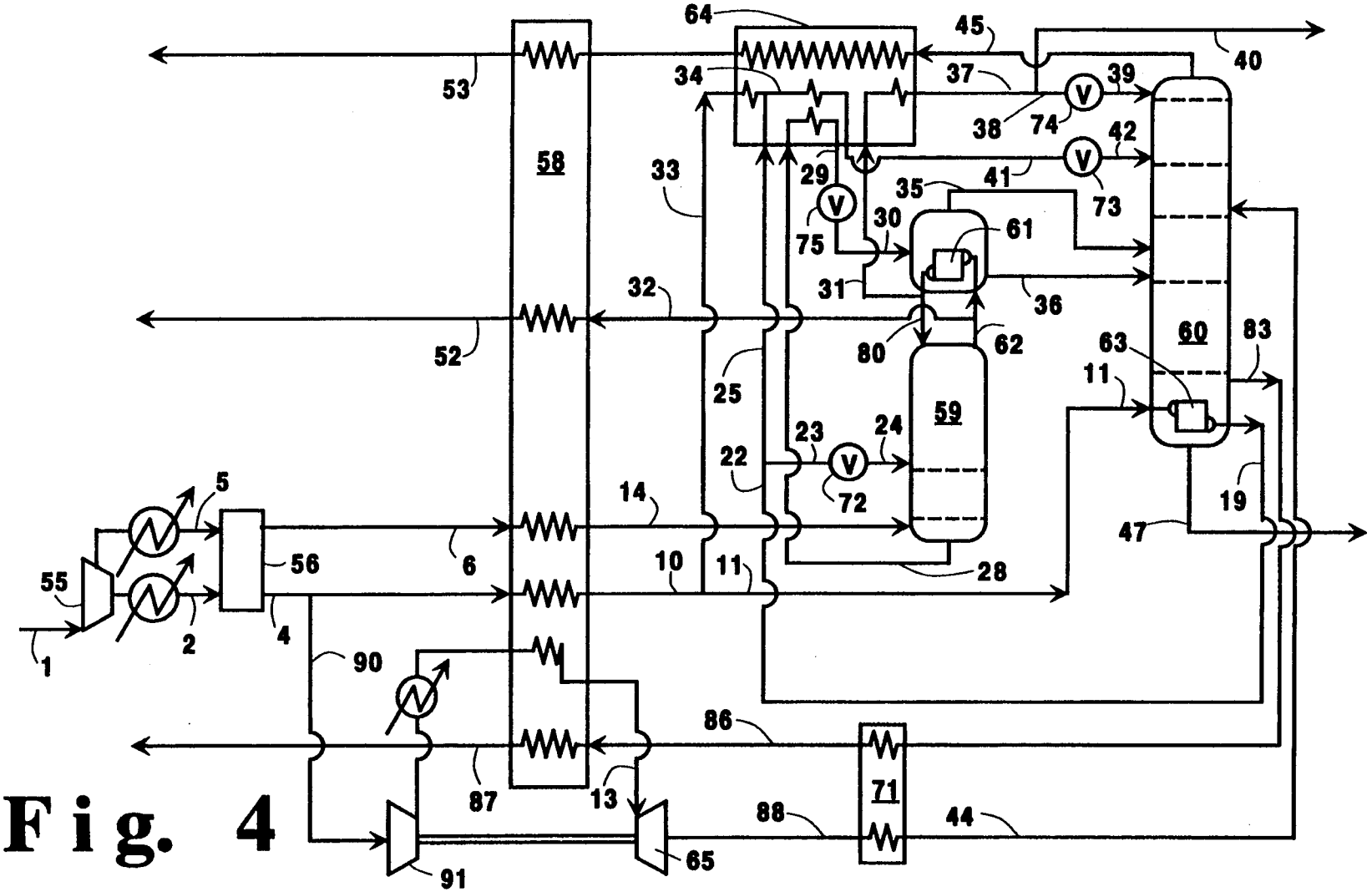
FIG. 4 is a schematic representation of another preferred embodiment of the invention wherein a feed stream is further compressed prior to turboexpansion to generate refrigeration.

FIGS. 2, 3 and 4 illustrate other preferred embodiments of the invention. The numerals in FIGS. 2, 3 and 4 correspond to those of FIG. 1 for the common elements and these common elements will not be described again in detail.

In the embodiment illustrated in FIG. 2, pressurized feed air stream 16 is passed into product boiler 67 wherein it is at least partially condensed by indirect heat exchange with pressurized lower purity oxygen liquid. Resulting feed air stream 81 is cooled by passage through heat exchanger 77, passed through valve 76 and, as stream 17, passed into phase separator 69. In this embodiment all of liquid stream 47 is passed through liquid pump 70 if liquid pump 70 is employed. Resulting pressurized stream 49 is warmed by passage through heat exchanger 77 and partially vaporized in product boiler 67. Vapor is passed out from product boiler 67 as stream 50 and warmed by passage through main heat exchanger 58 by indirect heat exchange with the feed air streams. Product lower purity oxygen vapor 54 is recovered from main heat exchanger 58. Liquid lower purity oxygen is recovered from product boiler 67 as stream 82.

In the embodiment illustrated in FIG. 3, there is not employed a further pressurized feed air stream. First feed air stream 11 is passed without further inputs into bottom reboiler 63 and there is no further input into feed air stream 19 prior to its being passed into the columns. All of liquid lower purity oxygen stream 47 withdrawn from second column 60 is recovered as liquid product. The majority of the lower purity oxygen production is withdrawn from second column 60 as vapor stream 83, warmed by indirect heat exchange with the feed air streams in main heat exchanger 58 and recovered as product lower purity oxygen in stream 84.

In the embodiment illustrated in FIG. 4, another feed air fraction 90 is compressed by passage through compressor 91 which is directly coupled to turboexpander 65. The further compressed stream is passed partly through main heat exchanger 58 and then turboexpanded through turboexpander 65 thus generating refrigeration and also driving compressor 91. Resulting turboexpanded stream 88 is cooled by passage through heat exchanger 71 and passed as stream 44 into second column 60. Lower purity oxygen vapor stream 83 is withdrawn from second column 60, warmed by passage through heat exchanger 71 and then passed as stream 86 through main heat exchanger 58 wherein it is warmed by indirect heat exchanger with the feed air streams. Resulting vapor stream 87 is recovered as lower purity oxygen product.

A computer simulation of the invention in accord with the embodiment illustrated in FIG. 1, except that there was no liquid product recovery and no gaseous nitrogen recovery from the first column, was carried out and the results are presented in Table I. This example is presented for illustrative purposes and is not intended to be limiting. The stream numbers in Table I correspond to those of FIG. 1.

TABLE I

| Stream No. | Normalized Flow (Total air flow =100) | Pressure (PSIA) | Composition |
|---|---|---|---|
| 14 | 37.5 | 43.4 | Air |
| 10 | 24.2 | 58.8 | Air |
| 16 | 25.8 | 188.3 | Air |
| 13 | 12.4 | 57.8 | Air |
| 12 | 23.3 | 58.8 | Air |
| 31 | 27.5 | 42.4 | $N_2$ with 2.4% $O_2$ |
| 45 | 78.9 | 18.1 | $N_2$ with 1.2% $O_2$ |
| 54 | 21.1 | 70.0 | 95% $O_2$, 3% Ar, 2% $N_2$ |

In the example reported in Table I, lower purity oxygen is produced with improved unit power savings over conventional air boiling cryogenic rectification systems with comparable oxygen recovery.

In Table II there is present a unit power comparison between the present invention and the prior art as exemplified by the cycles disclosed in U.S. Pat. Nos.

4,410,343 and 4,704,148 which are considered good examples of the heretofore present state of the art of cryogenic low purity oxygen cycles. In Table II the first line presents the unit power and oxygen recovery for the embodiment of the invention illustrated in FIG. 1, the second line presents these figures for the embodiment of the invention illustrated in FIG. 4, line 3 for the cycle disclosed in U.S. Pat. No. 4,704,148 and line 4 for the cycle disclosed in U.S. Pat. No. 4,410,343. There is also listed the percent reduction in unit power for each cycle using that of the '343 patent as the base.

TABLE II

| | Unit Power (KW-hr./lb mol.) | Difference (%) | Oxygen Recovery (%) |
|---|---|---|---|
| 1 | 3.101 | −7.5 | 95.49 |
| 2 | 3.167 | −5.6 | 97.40 |
| 3 | 3.251 | −3.0 | 95.95 |
| 4 | 3.353 | 0.0 | 98.30 |

As can be seen from the data presented in Table II, the embodiment of the invention illustrated in FIG. 1 has a substantial unit power improvement over all the other cycles even though oxygen recovery is less. As is known to those skilled in the art, all other things being equal, higher oxygen recovery results in less unit power consumption due to the commensurate decrease in air flow required for a given product oxygen flow. The power improvement of the present invention is due to the reduced air compressor discharge requirements, and occurs in spite of the lower oxygen recovery. The lower recovery is due to lower mass transfer driving forces (reflux ratios) in the distillation columns, and in this case is indicative of a process that is more optimal for low purity oxygen production because the lower driving forces are effectively converted into a power savings. The embodiment of the invention illustrated in FIG. 4 has a higher power requirement than that illustrated in FIG. 1 because it does not utilize liquid oxygen pumping. This embodiment has a higher oxygen recovery because of its recovery enhancement features.

Generally in the practice of this invention the pressure of the first feed air stream will exceed that of the second feed air stream by at least 5 psia although for very low oxygen purifies this pressure differential will be less. With the use of the dual pressure feed air streams, the operation of the first and second columns is effectively decoupled enabling the efficient generation of sufficient reflux and boilup for each column without causing one or the other column to operate at a pressure higher than necessary. This reduces overall feed compression requirements and allows for generation of the appropriate amount of refrigeration without compromising product yield for a wide range of equipment parameters and plant product requirements.

Although the invention has been described in detail with reference to certain preferred embodiments, those skilled in the art will recognize that there are other embodiments of the invention within the spirit and the scope of the claims.

I claim:

1. A cryogenic rectification method for producing lower purity oxygen comprising:

(A) providing a cryogenic rectification plant comprising a first column with a top condenser and a second column with a bottom reboiler, said first column operating at a pressure which exceeds that of the second column;

(B) providing a first feed air stream at a pressure within the range of from 39 to 100 psia and passing said feed air stream through said bottom reboiler;

(C) passing feed air from the bottom reboiler into at least one of said first and second columns;

(D) providing a second feed air stream at a pressure less than that of the first feed air stream and passing said second feed air stream into the first column;

(E) withdrawing lower purity oxygen from the second column and warming said withdrawn lower purity oxygen by indirect heat exchange with said first feed air stream and with said second feed air stream;

(F) recovering resulting warmed lower purity oxygen as product; and (G) producing nitrogen-enriched vapor and oxygen-enriched liquid in the first column, condensing nitrogen-enriched vapor by indirect heat exchange with oxygen-enriched liquid in the top condenser, employing condensed nitrogen-enriched fluid as reflux in at least one of the first and second columns, and passing resulting oxygen-enriched vapor from the top condenser into the second column without passing said resulting oxygen-enriched vapor through a pressure reduction step.

2. The method of claim 1 wherein the lower purity oxygen is withdrawn from the second column as liquid, increased in pressure, and vaporized prior to recovery.

3. The method of claim 1 wherein the lower purity oxygen is withdrawn from the second column as vapor and further comprising withdrawing additional lower purity oxygen from the second column as liquid and recovering said withdrawn liquid as additional lower purity oxygen product.

4. The method of claim 1 further comprising passing an additional feed air stream, having a pressure which exceeds that of the first feed air stream, in indirect heat exchange with liquid lower purity oxygen withdrawn from the second column.

5. The method of claim 1 further comprising recovering nitrogen-containing fluid from the cryogenic rectification plant having a nitrogen concentration which exceeds 95 mole percent.

6. The method of claim 1 further comprising turboexpanding a feed air stream to generate refrigeration and passing the turboexpanded feed air stream into the second column.

7. A cryogenic rectification apparatus for producing lower purity oxygen comprising:

(A) a first column with a top condenser and a second column with a bottom reboiler;

(B) a main heat exchanger, and means for passing a first feed stream to the main heat exchanger and from the main heat exchanger to the bottom reboiler;

(C) means for passing fluid from the bottom reboiler into at least one of said first and second columns;

(D) means for passing a second feed stream, at a pressure less than that of the first feed stream, to the main heat exchanger and from the main exchanger into the first column;

(E) means for passing product fluid from the second column to the main heat exchanger;

(F) means for recovering product fluid from the main heat exchanger; and (G) means for passing fluid from the upper portion of the first column into the top condenser, means for passing fluid from the lower portion of the first column into the top condenser, means for passing fluid from the top condenser into at least one of said first and second columns and means for passing vapor from the top condenser into the second column without a pressure reduction step.

8. The apparatus of claim 7 wherein the means for passing product fluid from the second column to the main heat exchanger further comprises a liquid pump.

9. The apparatus of claim 7 further comprising a compressor, means for passing an additional feed stream to the main heat exchanger and from the main heat exchanger into the second column.

10. The apparatus of claim 7 further comprising a turboexpander, means for passing a fluid stream to the turboexpander, and means for passing a fluid stream from the turboexpander into the second column.

* * * * *